US008080197B2

(12) United States Patent
Meerman et al.

(10) Patent No.: US 8,080,197 B2
(45) Date of Patent: Dec. 20, 2011

(54) METHOD FOR MANUFACTURING FILAMENTS FROM AN OPTICALLY ANISOTROPIC SPINNING SOLUTION AND AIR GAP SPINNING DEVICE

(75) Inventors: Johannes Jacobus Meerman, Arnhem (NL); Wilhelmus Marie Roelofs, Dieren (NL)

(73) Assignee: Teijin Aramid B.V., Arnhem (NL)

( * ) Notice: Subject to any disclaimer, the term of this patent is extended or adjusted under 35 U.S.C. 154(b) by 1028 days.

(21) Appl. No.: 10/500,713

(22) PCT Filed: Jan. 18, 2003

(86) PCT No.: PCT/EP03/00471

§ 371 (c)(1),
(2), (4) Date: Jul. 6, 2004

(87) PCT Pub. No.: WO03/062509

PCT Pub. Date: Jul. 31, 2003

(65) Prior Publication Data

US 2005/0179162 A1 Aug. 18, 2005

(30) Foreign Application Priority Data

Jan. 24, 2002 (EP) ..... 02001635

(51) Int. Cl.
*D01D 5/06* (2006.01)
*B29C 47/00* (2006.01)
*B28B 5/00* (2006.01)

(52) U.S. Cl. ..... 264/178 F; 264/172.16; 264/178 R; 425/66; 425/67; 425/71; 425/72.2; 425/464

(58) Field of Classification Search ..... None
See application file for complete search history.

(56) References Cited

U.S. PATENT DOCUMENTS

| | | | | |
|---|---|---|---|---|
| 4,193,962 | A * | 3/1980 | Roberts | 264/178 F |
| 4,320,081 | A | 3/1982 | Lammers | |
| 4,702,876 | A | 10/1987 | Ebregt et al. | |
| 5,945,054 | A * | 8/1999 | Meerman et al. | 264/184 |

FOREIGN PATENT DOCUMENTS

| | | |
|---|---|---|
| EP | 0 168 879 A1 | 1/1986 |
| JP | 02 112409 A | 4/1990 |
| WO | WO 97/15706 | 1/1997 |

* cited by examiner

*Primary Examiner* — Jeffrey Wollschlager
(74) *Attorney, Agent, or Firm* — Oliff & Berridge, PLC

(57) ABSTRACT

The invention pertains to a method for manufacturing filaments from an optically anisotropic spinning solution in which the spinning solution is extruded through a spinneret including a spinning field with a plurality of spinning orifices into a coagulation bath through a slot or diaphragm, the edges thereof being formed by plates with upper and lower sides. The upper sides of the plates are defined as the sides having the shortest distance to the spinning field, wherein the line through the center of the spinning field and perpendicular to the upper sides is located a distance (d) from a parallel line through the center of the slot or diaphragm. The projection of the slot or diaphragm has about the same size and shape as the projection of the spinning field. The plane of the upper side of one plate has a shorter distance to the center of the spinning field than the plane of the upper side of the other plate, and the line has a smaller distance to the edge of plate than to edge of plate. Furthermore, the invention pertains to an air gap spinning device for performing the method.

7 Claims, 2 Drawing Sheets

METHOD FOR MANUFACTURING FILAMENTS FROM AN OPTICALLY ANISOTROPIC SPINNING SOLUTION AND AIR GAP SPINNING DEVICE

CROSS-REFERENCE TO RELATED APPLICATION

The present application is the U.S. National stage application of International Application No. PCT/EP03/00471, filed on Jan. 18, 2003.

BACKGROUND OF THE INVENTION

1. Field of Invention

The invention pertains to a method for manufacturing filaments from an optically anisotropic spinning solution in which the spinning solution is extruded through a spinneret comprising a spinning field with a plurality of spinning orifices, into a coagulation bath through a slot or diaphragm, the edges thereof being formed by plates with upper and lower sides, the upper sides of the plates being defined as the sides having the shortest distance to the spinning field, and to an air gap spinning device for performing said method.

2. Description of Related Art

Such a method is known from European Patent No. 0,904,431, wherein it has been disclosed that the motion of the coagulant surface can be reduced when the edges of adjacent openings are at different heights ("on different levels"). In the examples of said patent specification, filaments of good strength are made. This method, however, suffers from the disadvantage that the coagulation bath during the spinning procedure is still in continuous movement, which is particularly troublesome when applied on a larger scale. Such movement has a disadvantageous effect on the filaments formed, since the filaments in the coagulation bath will stick together, rendering the end product unsuitable for use in the envisaged high-grade applications (e.g., woven fabrics or composite reinforcement).

When very small air gaps are employed (say, smaller than 4 mm), there is a risk of the coagulant, which will always display some motion under the influence of the filament bundle (vibrations, small waves, etc.), making contact with the spinneret plate. When this happens, the process may be disturbed to such a degree, that it will be required to be stopped. Hence, if very small air gaps are to be used, it is of the essence to have the calmest possible coagulation bath surface. It was found that the extent to which the coagulation bath surface is in motion is highly dependent on the geometry of the coagulation bath's bottom. Particularly, when use is made of more than two spinning fields and a corresponding number of discharge openings in the bottom of the coagulation bath, the extent to which there is motion at the coagulant surface can be reduced substantially by introducing the geometry of the present invention. A very simple and effective embodiment that provides a substantial improvement of the known method is the one of the present invention.

SUMMARY OF THE INVENTION

An object of the present invention is to provide a process enabling the high-speed spinning (>300 m/min) of a plurality of filaments having good to very good physical properties, the process conditions being such that commercial production is possible without having disturbing effects of the coagulation bath surface. This object is attained by adapting the process of the state of the art as indicated above in such a manner that the positions of the spinning field and the slot or diaphragm are such that a line through the center of the spinning field and perpendicular to the upper sides of the plates is put at a distance (d) to a parallel line through the center of the slot or diaphragm, the projection of which has about the same size and shape as the projection of the spinning field, and wherein the plane of the upper side of one plate has a shorter distance to the center of the spinning field than the plane of the upper side of the other plate, and the line through the center of the spinning field has a smaller distance to the edge of the plate with the upper side having the largest distance to the center of the spinning field than to edge of the other plate.

The edges of the slot or diaphragm are formed by at least two plates, the upper side of one plate having a shorter distance to the spinning field than the upper side of the other plate. The line through the center of the spinning field and perpendicular to the upper sides of the plates has a smaller distance to the edge of the plate with the upper side having the largest distance to the spinning field, than to edge of the other plate. The distance of the upper side of a plate to the spinning field can be defined as the shortest distance of the center of the spinning field to the plane of the upper side of the plate.

Surprisingly, it was found that this process makes it possible to manufacture filaments having good physical properties at a small pitch (and hence a large number of filaments per unit of area) at a comparatively high acid concentration in the coagulation bath, resulting in an economical process with a small waste stream. As can be seen from the example, the number of stickings occurring during the process (from filaments making contact before there has been sufficient coagulation of the outer shell) is low. No substantial motion occurred in the coagulation bath. A possible explanation of this phenomenon is given below.

At the edges of the discharge openings, the liquid, which is entrained by the outgoing filament bundle is stopped or scraped off. Because of inertia, the liquid retains (part of) its speed and flows parallel to the bottom in the direction of the adjacent discharge opening. However, coagulant flow also approaches from the direction of this adjacent discharge opening, resulting in the collision of streams flowing in opposite directions. The liquid is pushed up as a result, and the coagulation bath surface rises above this stagnation point. Obviously, the damming up of the coagulant constitutes a significant restriction when selecting the air gap; after all, the coagulant has to be prevented from making contact with the spinneret plate.

When the aforementioned streams come together at different levels, the disclosed damming up does not arise. On the contrary, because the speed of one of the streams (i.e., the one flowing from the lowest edge) already has a component going in the direction of the liquid surface, there is extinction and the liquid surface remains calm.

When the coagulation bath has a depth of more than 10 mm and less than 20 mm (preferably less than 15 mm), on the one hand the filaments encounter only slight resistance in the bath and the use of coagulant is low, and on the other hand the residence time in the coagulation bath is long enough to achieve the required coagulation.

The process according to the invention makes it possible to use a comparatively compact spinning apparatus or to equip existing spinning apparatus with spinneret plates with a higher number of spinning orifices. For instance, the production of 1000 to 3000 filaments per spinning position is possible.

The favorable results are probably attributable to the low resistance experienced by the coagulant as it flows to the core of the filament bundle (alternatively, this may be referred to as high filament bundle permeability). The resistance depends on the route to be traveled, i.e., half of the width of the filament bundle, and the space between the various filaments (the pitch).

Preferably, the spinning orifices are grouped in more than one spinning field. The separate sections can then be positioned vis-à-vis one another such as to ensure the least possible hindrance of the coagulant's approaching flow and the fullest possible avoidance of disturbing the coagulation bath.

Also, the separate spinning fields preferably are positioned such that the maximum space between the outermost filaments is relatively small at the moment of extrusion from the spinning orifices of the different spinning fields, so that the convergence to, say, a guide, may be low.

One highly effective way of positioning the spinning fields takes the form of the spinning fields being distributed equidistantly over a circle, with the longitudinal direction of each of the spinning fields coinciding with a radius. Such positioning hinders the approaching flow of the coagulant hardly (if at all) and gives a low convergence for each of the filament bundles. The spinning fields may have any desirable shape, but in many instances rectangular spinning fields are preferred.

To further reduce convergence in the filament bundle or filament bundles it is preferred to provide the bottom of the coagulation bath per spinning field with an opening, the projection of which preferably has a similar shape and is somewhat narrower in width than the projection of the spinning field. Furthermore, if the opening has a somewhat greater length than the spinning field, it facilitates the in-spinning process. In that case, neither the length nor the width of the opening in the bottom of the coagulation bath will give rise to substantial filament bundle convergence, and the filaments are prevented from being pressed together or suffering damage from scraping along the edge of the slot or diaphragm. In general the difference of the length and the width with regard to the spinning field should be moderate. Such difference is preferably not more than 60% of the length and not more than 100% of the width of the spinning field, more preferably not more than 35% and 55% for the length and the width, respectively.

The physical properties of the filaments obtained by the process according to the invention can be enhanced still further by selecting a range for the distance traveled by the threadlike extrudates through the gaseous inert medium (the air gap) of more than 0.5 mm and less than 16 mm.

Within the framework of the invention the term pitch is used to indicate the average distance between the spinning orifice centers of adjacent spinning orifices.

BRIEF DESCRIPTION OF THE DRAWINGS

The invention will be further illustrated below with reference to an example and figures, without being limited by this example.

DETAILED DESCRIPTION OF PREFERRED EMBODIMENTS

Figure 1:
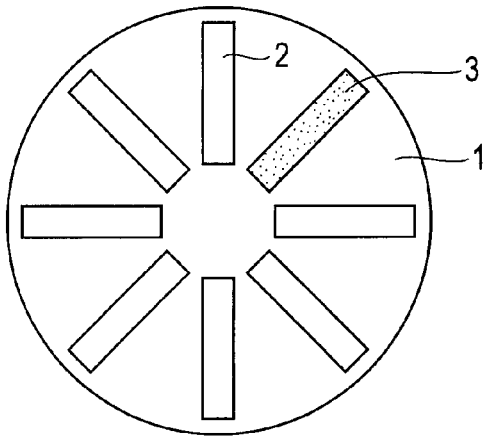
FIG. 1 shows a bottom view of a spinneret according to the invention provided with eight rectangular spinning fields.

In FIG. 1, a spinneret 1 with eight rectangular spinning fields 2 is shown. Each spinning field 2 contains a plurality of spinning orifices 3 (only depicted in one of the spinning fields).

Figure 2:
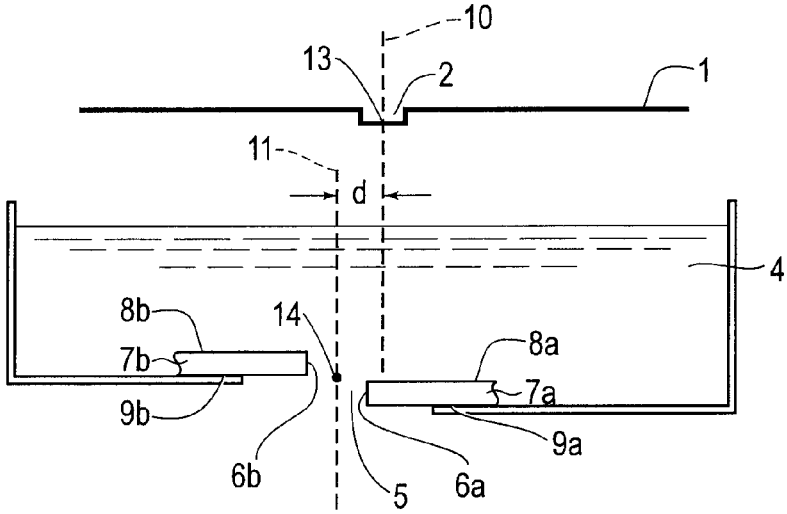
FIG. 2 shows a cross sectional view of a spinning device according to the invention.
Figure 3:
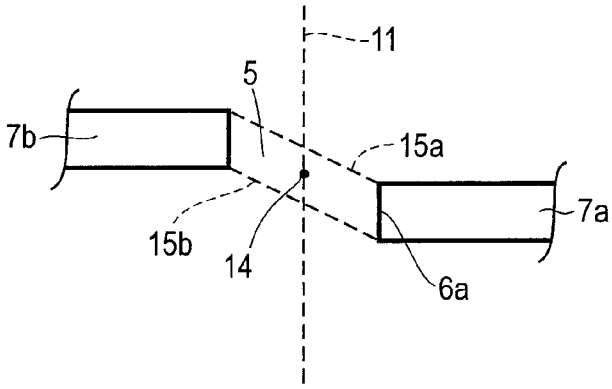
FIG. 3 shows a detail of the diaphragm of the spinning device of FIG. 2.

In FIG. 2, a device according to the invention is shown to which the method of the invention can be explained. The optically anisotropic spinning solution is extruded through a spinneret 1 comprising spinning fields 2 with a plurality of spinning orifices 3, into a coagulation bath 4 through a slot or diaphragm 5, edges 6*a*,6*b* thereof being formed by plates 7*a*,7*b* with upper sides 8*a*,8*b* and lower sides 9*a*,9*b*, the upper sides 8*a*,8*b* of the plates 7*a*,7*b* being defined as the sides having the shortest distance to the spinning field 2. A line 10 through the center 13 of the spinning field 2 and perpendicular to the upper sides 8*a*,8*b* is put at a distance d to a parallel line 11 through the center 14 of the slot or diaphragm 5. The center 14 is defined as the center of the area that is between and limited by the edges 6*a* and 6*b* and the line 15*a* being the line between the upper corners of edges 6*a* and 6*b*, and line 15*b* being the line between the lower corners of edges 6*a* and 6*b*, which area is the slot or diaphragm 5. In FIG. 3, the cross section of this area and the center 14 are depicted.

Figure 4:
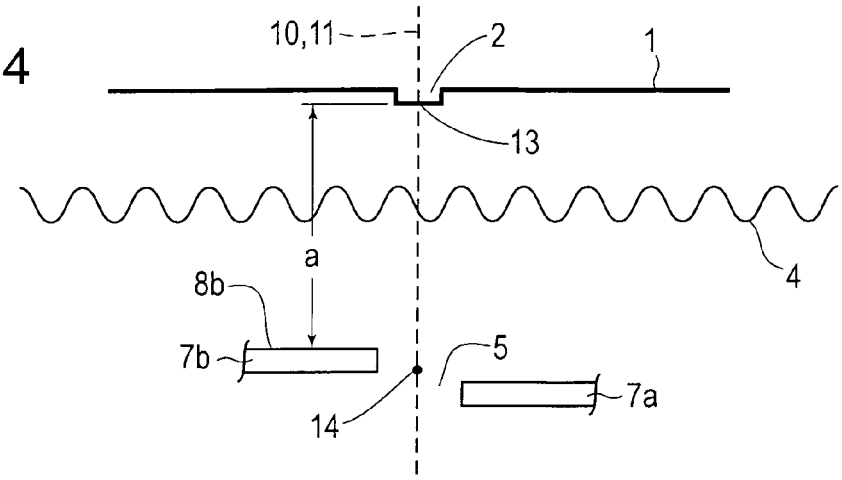
FIG. 4-6 show the effect on the occurrence of impoundments in a coagulation bath according to the invention and in reference baths not according to the invention.

The distance of a plate 7*a*,7*b* to the spinning field 2 is defined as the shortest distance of the plane of the upper side of the plates 7*a*,7*b* and a perpendicular plane through the center 13 of the spinning field 2. In FIG. 4, the distance "a" between perpendicular plane through the center 13 of a convex-shaped spinning field 2 and the upper side 8*b* of plate 7*b* is depicted.

In another embodiment (not shown), one of the plates is thicker than the other plate. When the lower sides of these plates are brought at the same or about the same height, the upper sides of the plates will have different distances to center 13 of the spinning field 2. In all embodiments, each of the spinning fields 2 is in combination with a slot or diaphragm 5. One slot or diaphragm 5 cannot be in contact (through the spinning fibers) with more than one spinning field 2.

The thickness of each of the plates 7*a*,7*b* is preferably independently chosen to be between 0.5 and 5 mm.

It is preferred that the air gap spinning device of the invention has a shorter distance of plate 7*b* to the spinning field 2 than of the other plate 7*a* to said spinning field 2, and that line 10 has a smaller distance to edge 6*a* of plate 7*a* than to edge 6*b* of the other plate 7*b*. The distance d thereby is preferably 0.4 to 50 mm, more preferably 1 to 2 mm.

It was found to be particularly useful to have plates 7*a*,7*b* with a thickness that is about the same as the distance d between the line 10 and the line 11.

Particularly good results are obtained when (the projection of) the slot or diaphragm 5 has about the same size and shape as that of the spinning field 2. In practice, the slot or diaphragm 5 has the same shape, but is preferably slightly smaller than the spinning field 2. When, furthermore, the slot or diaphragm 5 is slightly longer than the spinning field, in spinning is facilitated. The spinning device is preferably closed with a covering plate just above the slot or diaphragm 5 (not shown).

EXAMPLE

In an analogous manner to the procedure described in Example 6 of U.S. Pat. No. 4,308,374, poly(para-phenylene terephthalamide) was prepared using a mixture of N-methyl pyrrolidone and calcium chloride. After neutralization, washing and drying, a polymer having an inherent viscosity of 5.4 was obtained.

The polymer was dissolved in sulfuric acid of 99.8% concentration in the manner described in Example 3 of U.S. Pat. No. 4,320,081. The thus prepared spinning solution had a polymer concentration of 19.4%.

Figure 5:
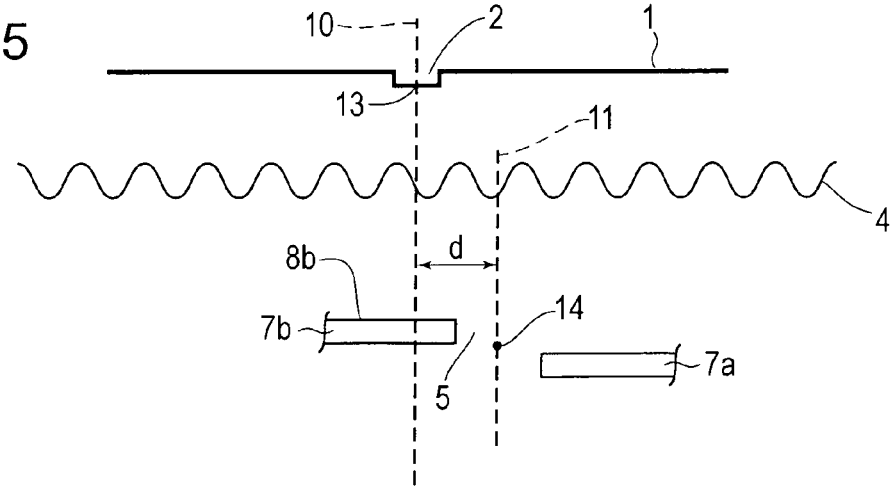
Figure 6:
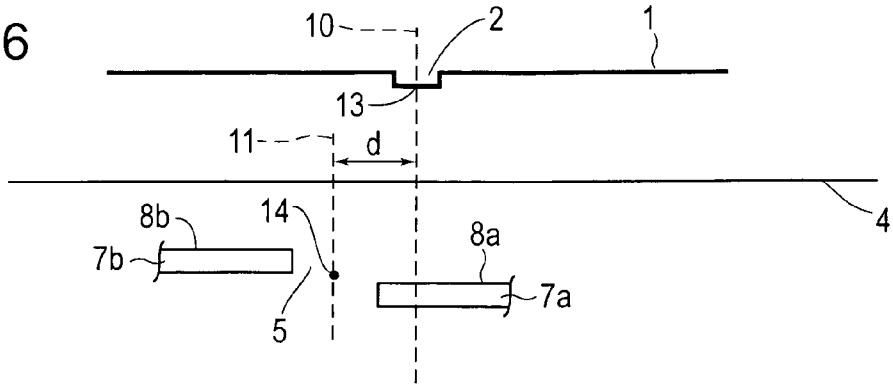

The spinning solution was spun using different spinneret/diaphragm embodiments (see FIGS. 4-6).

A circular spinneret 1 according to the spinneret disclosed in European Pat. No. 0,904,431, having an outer diameter of 90 mm was provided with eight rectangular spinning fields 2 (2.65 mm width and 18.4 mm length) each having 250 spinning orifices 3, and being distributed equidistantly over the spinneret 1. The spinning orifices 3 had a diameter of 65 μm and a distance of one to the other (pitch) of 0.5 mm (the ratio of the pitch to the width of the spinning field 2 thus was 0.5/2.65=0.19).

The spinning solution was spun through an air gap of 6 mm length into a coagulation bath. The coagulant was made up of water having a sulfuric acid concentration of 2% and a temperature of 13° C. The spinning speed was 300 m/min and the draw ratio was 6.8 to a total fiber bundle of 3360 dtex. The physical properties were determined in accordance with ASTM D885.

At 10 mm below the surface of the coagulation bath there were provided eight diaphragms (rectangular 1.26 mm×24 mm) each of which can be positioned slightly shifted beneath a spinning field. The diaphragm plates 7*a*,7*b* could be shifted both at the same time in the same direction perpendicular to the filaments, by which the positioning was possible of the diaphragms 5 with respect to the spinning fields 2. The shift distance could be read from a grade mark. By this method, line 10 through the center 13 of the spinning field 2 and perpendicular to upper sides 8*a*,8*b* of the plates 7*a*,7*b* could set at a distance d to a parallel line 11 through the center 14 of the diaphragm 5, varying from −10 to +10 mm (including 0 mm when lines 10 and 11 coincide with each other).

When d was set at 0 mm, spinning was practically impossible because of the severe coagulation bath movements with impoundments of the bath as high as 5 mm. This is shown in FIG. 4, a comparative example.

A similar occurrence of movements resulting in impoundments up to 4 mm height is shown in FIG. 5 wherein the spinning fields 2 are shifted with distance d minus 1.5 mm in the direction of plates 7*b* with the upper sides 8*b* having the shortest distance to the centers 13 of the spinning fields with regard to the upper sides 8*a*, a comparative example. Spinning was very difficult in this embodiment and it was necessary to lengthen the air gap to unacceptable dimensions.

Furthermore, a substantial increase of the degree of sticking of the filaments was found (up to 25% of the filaments were subject to sticking).

In FIG. 6, a situation is shown wherein the spinning fields 2 are shifted with distance d plus 1.5 mm in the direction of plates 7*a* with the upper sides 8*a* having the largest distance to the centers 13 of the spinning fields with regard to the upper sides 8*b*. No disturbing movements of the coagulation bath occurred and spinning could easily be performed. Yarn was made with this embodiment having a bundle linear density of 3420 dtex, yarn tenacity 2225 mN/tex and <1% degree of sticking.

It was found that optimum results were obtained for 0.5 mm<d<2 mm.

The invention claimed is:

1. A method for manufacturing filaments from an optically anisotropic spinning solution comprising extruding the spinning solution through a spinneret comprising a spinning field with a plurality of spinning orifices into a coagulation bath through a slot or diaphragm, the edges of the slot or diaphragm being formed by plates with upper sides and lower sides, the upper side of each plate being defined as the side having the shortest distance to the spinning field, wherein a line through the center of the spinning field and perpendicular to the upper sides is located at a distance (d) from a parallel line through the center of the slot or diaphragm, wherein the slot or diaphragm has substantially the same size and shape as the spinning field, and wherein the plane of the upper side of one of the plates has a shorter distance to the center of the spinning field than the plane of the upper side of the other of the plates, and the line through the center of the spinning field has a smaller distance to the edge of one of the plates than to the edge of the other of the plates, and wherein the slot or diaphragm is positioned at the bottom of the coagulation bath.

2. An air gap spinning device comprising a spinneret comprising a spinning field with a plurality of spinning orifices, and a slot or diaphragm with edges formed by plates with upper sides and lower sides, the upper side of each plate being defined as the side having the shortest distance to the spinning field, wherein a line through a center of the spinning field and perpendicular to the upper sides has a distance (d) from a parallel line through the center of the slot or diaphragm, wherein the slot or diaphragm has substantially the same size and shape as the spinning field, and wherein the plane of the upper side of one of the plates has the shorter distance to the center of the spinning field than the plane of an upper side of the other of the plates, and the line through the center of the spinning field has a smaller distance to the edge of the plate of which the upper side has the longest distance to the center of the spinning field than to the edge of the other of the plates, and wherein the slot or diaphragm is positioned at the bottom of the coagulation bath.

3. The air gap spinning device of claim 2, wherein the thickness of each of the plates is independently about 0.5 to 5 mm.

4. The air gap spinning device of claim 2, wherein the distance (d) between the line through the center of the spinning field and the parallel line through the center of the slot or diaphragm is about 0.4 to 50 mm.

5. The air gap spinning device of claim 2, wherein the distance (d) between the line through the center of the spinning field and the parallel line through the center of the slot or diaphragm is about 1 to 2 mm.

6. The air gap spinning device of claim 2, wherein the thickness of each of the plates is about the same as the distance(d) between the line through the center of the spinning field and the parallel line through the center of the slot or diaphragm.

7. The air gap spinning device of claim 2, wherein both the spinning field and the slot or diaphragm have a rectangular shape, and wherein the slot or diaphragm has a smaller width and is longer than the spinning field.

* * * * *

UNITED STATES PATENT AND TRADEMARK OFFICE

CERTIFICATE OF CORRECTION

PATENT NO. : 8,080,197 B2
APPLICATION NO. : 10/500713
DATED : December 20, 2011
INVENTOR(S) : Johannes Jacobus Meerman et al.

It is certified that error appears in the above-identified patent and that said Letters Patent is hereby corrected as shown below:

On the Title page,
Please amend Item (57) as follows:

(57) ABSTRACT - The invention pertains to a method for manufacturing filaments from an optically anisotropic spinning solution in which the spinning solution is extruded through a spinneret including a spinning field with a plurality of spinning orifices into a coagulation bath through a slot or diaphragm, the edges thereof being formed by plates with upper and lower sides. The upper sides of the plates are defined as the sides having the shortest distance to the spinning field, wherein the line through the center of the spinning field and perpendicular to the upper sides is located a distance (d) from a parallel line through the center of the slot or diaphragm. The projection of the slot or diaphragm has about the same size and shape as the projection of the spinning field. The plane of the upper side of one plate has a shorter distance to the center of the spinning field than the plane of the upper side of the other plate, and the line has a smaller distance to the edge of the plate with the upper side having the largest distance to the center of the spinning field than to the edge of the other plate. Furthermore, the invention pertains to an air gap spinning device for performing the method.

Signed and Sealed this
Twenty-seventh Day of March, 2012

David J. Kappos

David J. Kappos
*Director of the United States Patent and Trademark Office*